US008720457B2

(12) United States Patent
Amalric et al.

(10) Patent No.: US 8,720,457 B2
(45) Date of Patent: May 13, 2014

(54) BOTTOM-TRIGGERING WIND SAFETY UMBRELLA

(76) Inventors: Bernard Amalric, L'Union (FR); Frédéric Cannac, buzet sur Tarn (FR); Jean-Paul Taillefer, buzet sur Tarn (FR)

( * ) Notice: Subject to any disclaimer, the term of this patent is extended or adjusted under 35 U.S.C. 154(b) by 17 days.

(21) Appl. No.: 13/505,100

(22) PCT Filed: Oct. 27, 2010

(86) PCT No.: PCT/FR2010/000704
§ 371 (c)(1),
(2), (4) Date: Apr. 30, 2012

(87) PCT Pub. No.: WO2011/055027
PCT Pub. Date: May 12, 2011

(65) Prior Publication Data

US 2012/0211040 A1 Aug. 23, 2012

(30) Foreign Application Priority Data

Nov. 6, 2009 (FR) ..... 09 05342

(51) Int. Cl.
*A45B 25/14* (2006.01)
*A45B 25/16* (2006.01)

(52) U.S. Cl.
USPC ..... 135/20.3; 135/22; 135/37

(58) Field of Classification Search
USPC ..... 135/20.3, 22, 24, 37, 98
See application file for complete search history.

(56) References Cited

U.S. PATENT DOCUMENTS

| | | | | | |
|---|---|---|---|---|---|
| 3,003,509 | A | * | 10/1961 | Hibbard | 135/25.4 |
| 4,319,600 | A | * | 3/1982 | Roche | 135/20.3 |
| 5,913,321 | A | * | 6/1999 | Yung | 135/24 |
| 7,665,477 | B1 | * | 2/2010 | Hathaway | 135/20.3 |

FOREIGN PATENT DOCUMENTS

| | | |
|---|---|---|
| GB | 2268056 | 1/1994 |
| WO | WO03063636 | 8/2003 |
| WO | WO2008022364 | 2/2008 |

* cited by examiner

*Primary Examiner* — Noah Chandler Hawk
(74) *Attorney, Agent, or Firm* — Defillo & Associates, Inc.; Evelyn A. Defillo

(57) ABSTRACT

The invention relates to an umbrella including a security system having a triggering device located on the contact area of the mast with the ground. The triggering device includes a slider, a slider return spring, a flexible transmission assembly connected to the head of the slider; a mechanism to inactivate the trigger, including a cam pivotally mounted on the trigger and capable of resting against the mast.

4 Claims, 4 Drawing Sheets

BOTTOM-TRIGGERING WIND SAFETY UMBRELLA

CROSS REFERENCE TO RELATED APPLICATION

This application is a national stage entry of PCT/FR2010/000704 filed Oct. 27, 2010, under the International Convention claiming priority over French Application No. 0905342 filed Nov. 6, 2009.

FIELD OF THE INVENTION

The present invention relates to a sunshade equipped with a safety system for wind, which is triggered by an actuator located at the bottom of its direct support with the ground.

BACKGROUND OF THE INVENTION

Generally, sunshades consist of two separate elements: of an upper portion comprising the mast and the umbrella, and of a spike in the lower portion. There also exists sunshades secured for wind by an automatic closing system, the triggering of which is initiated by the head when they fall back onto the ground after having been carried off by a gust of wind. These types of secured sunshades are generally well adapted to use on beaches. On the other hand, when the sunshade is used on a terrace or on a table, and when a gust of wind tends to lift it, it is important that the latter closes rapidly for safety in order to prevent the table from being turned upside down.

With the present invention it is possible to solve this problem very simply by integrating a spring mechanism at the bottom of the spike of the sunshade or quite simply of its mast so that slight lifting of the latter is sufficient for triggering its closing. Further, the invention remains applicable to a telescopic spike with opposite sliding, i.e. it is the male portion and the mast is the female portion, thereby providing two major advantages: no mechanism is apparent on the outside on the one hand and for storing or transporting the sunshade on the other hand, the telescopic pole entirely enters the mast, which is most practical and less bulky.

SUMMARY OF THE INVENTION

The sunshade according to the invention comprises the mast 1 supporting the whole of the elements which are found in conventional sunshades: ribs, corolla, fabrics, handle and lock, in the lower portion a telescopic strand 2. which ensures the spike 2 function of the sunshade, a blocking system 3, a slide 4 with a return spring 5, a chain with balls 6 for transmitting forces, a piano string 7, a cam 8 mounted on the locking trigger 9 and its return spring 10.

DETAILED DESCRIPTION OF THE INVENTION

Figure 1:
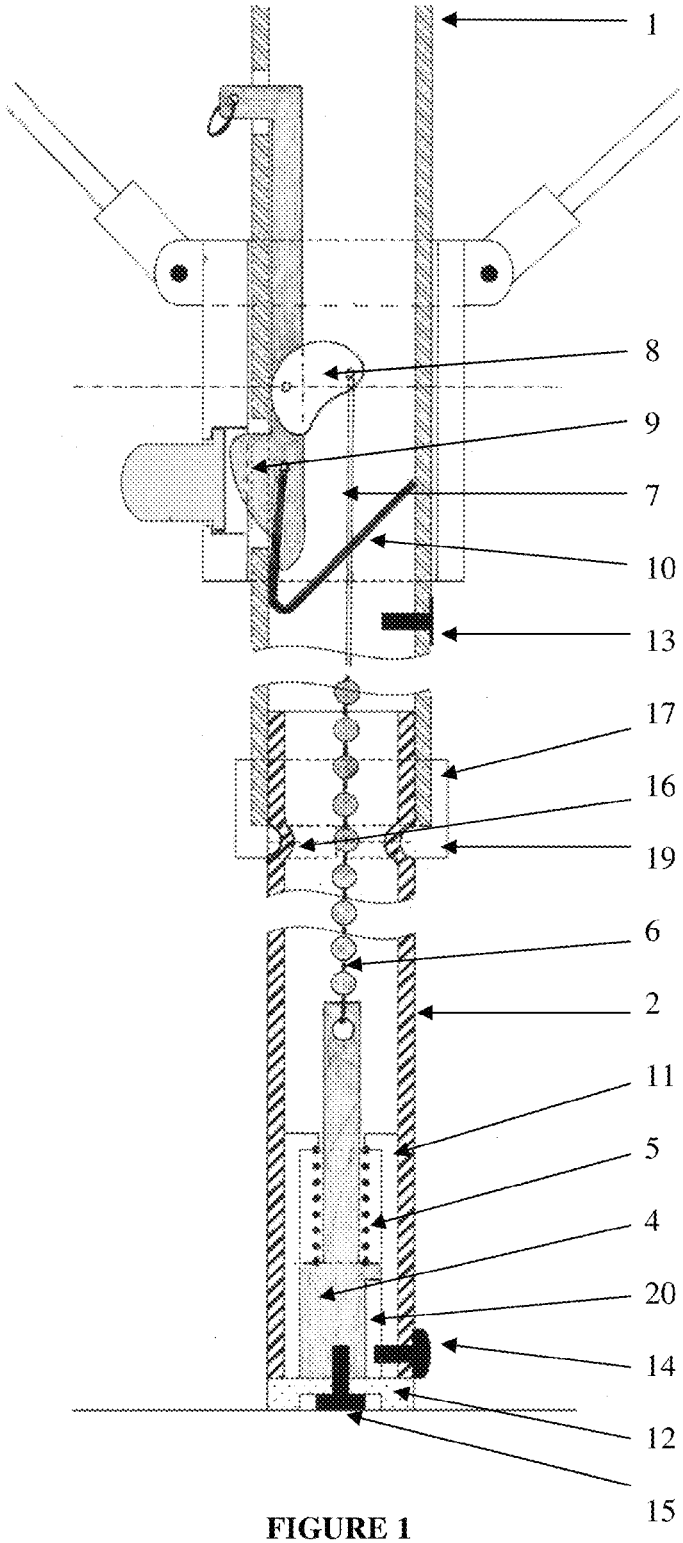
FIG. 1 shows the open sunshade in the configuration of use, with its spike deployed, and the trigger system armed.

FIG. 1 is a sectional view showing an exemplary embodiment of a sunshade equipped with a safety system for wind which triggers at the bottom of its telescopic spike.

This sunshade is locked like any sunshade by the trigger 9 provided by its return spring 10. On this trigger, inside the mast 1, a cam 8 pivots when it is actuated eccentrically by a piano string 7. The geometry of the cam 8 is defined so that its concave area will come into contact on the internal wall on the trigger 9 side and so that when it is tensioned downwards by the piano string 7, its circular motion is accompanied by a translation driving the trigger 9 inwards inducing automatic closing of the sunshade.

At the bottom of the spike 2 is fitted a sheath 11 containing the triggering system including the slide 4 with the return spring 5, the whole being closed by the lid 12 blocked by the screw 15. Translational guidance of the slide is provided by the screw 14, the end tenon is accommodated in the groove 20. A chain 6 made with a series of links made with ball sockets jointed together, provide the advantage of perfect flexibility when the spike goes into the mast 1 for storage, without entangling the ball chain 6 when it is pushed back upwards. The total length of the ball chain 6 and of the piano string 7 is suitably determined so that in the rest position, this transmission assembly is without any slack and without any play.

Figure 2:
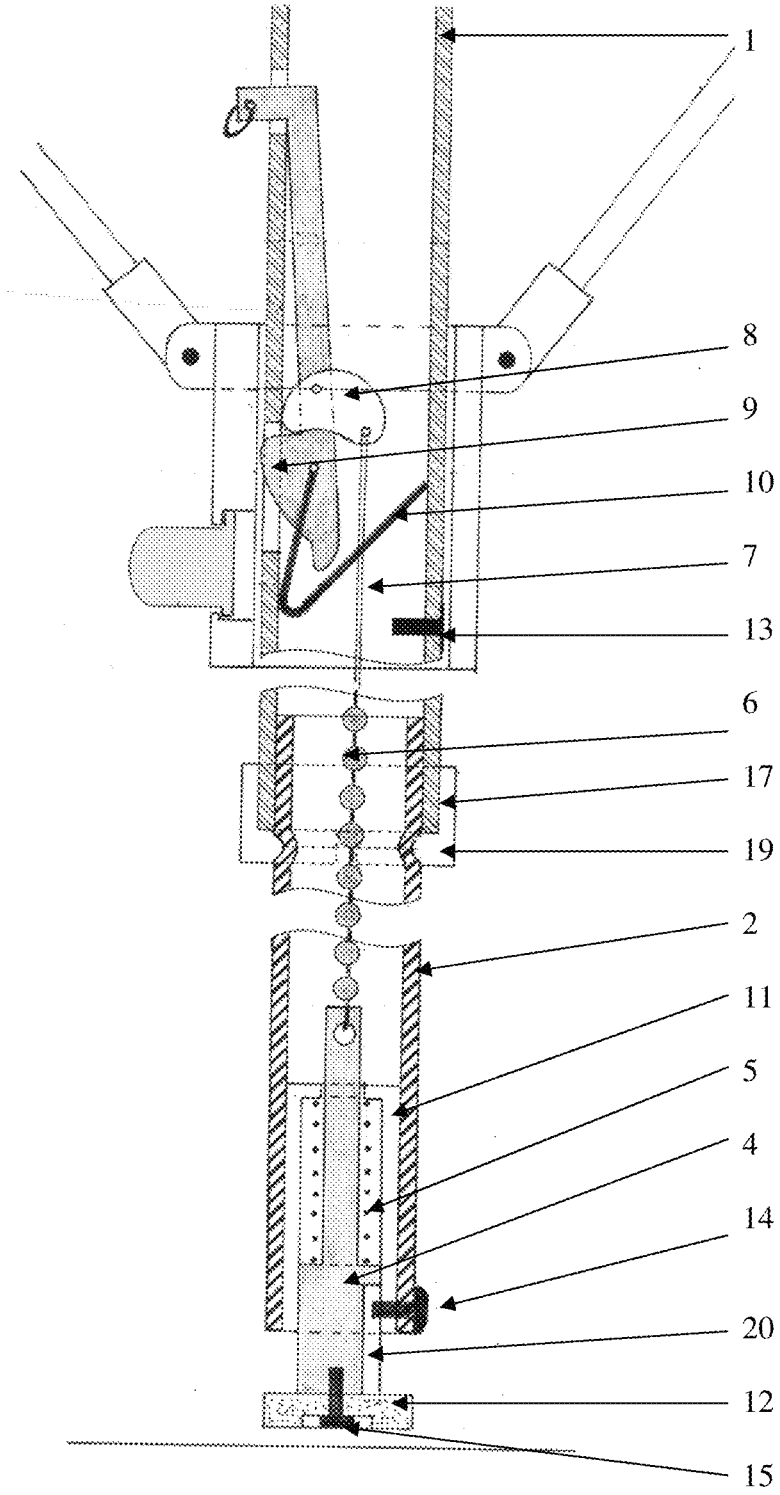
FIG. 2 shows the sunshade slightly lifted by wind, with its active safety system which triggers the release and therefore the closing of the sunshade.

The operating mode of the safety sunshade for wind with triggering at the bottom of the spike 2 is illustrated by FIG. 2. At rest, the weight of the sunshade squashes the spring 5, and the slide 4 is found in the high abutment position inside its sheath. As soon as the wind tends to lift the sunshade, this pre-tensioned spring expands and pushes back the slide downwards, driving the movement transmission assembly formed by the ball chain 6 and the piano string 7. The latter causes pivoting of the cam 8 which, bearing upon the internal wall of the mast 1, horizontally translates the trigger 9, which compresses its return spring 10 in order to finally ensure automatic closing of the sunshade.

Conversely, for putting the sunshade into the configuration of use, the operating procedure is the following: the unblocking system 3 is released, the telescopic spike 2 is extracted until it reaches its end-of-travel abutment achieved by the ring 17 including elastic tabs 19 which will radially clasp the spike which includes an annular groove 16 provided for this purpose thus being completely deployed and self-blocked at the optimum length, corresponding to the setting of the length without any slack and without any play of the chain movement transmission and piano string assembly.

The sunshade is thus laid vertically on its spike and its own weight is sufficient for compressing the spring .5 with the slide 4, allowing the transmission assembly to induce pivoting of the cam into the rest position, thus the trigger 9, pushed back by its return spring 10 may be radially extracted so that the umbrella is automatically locked after having been unfurled.

Figure 3:
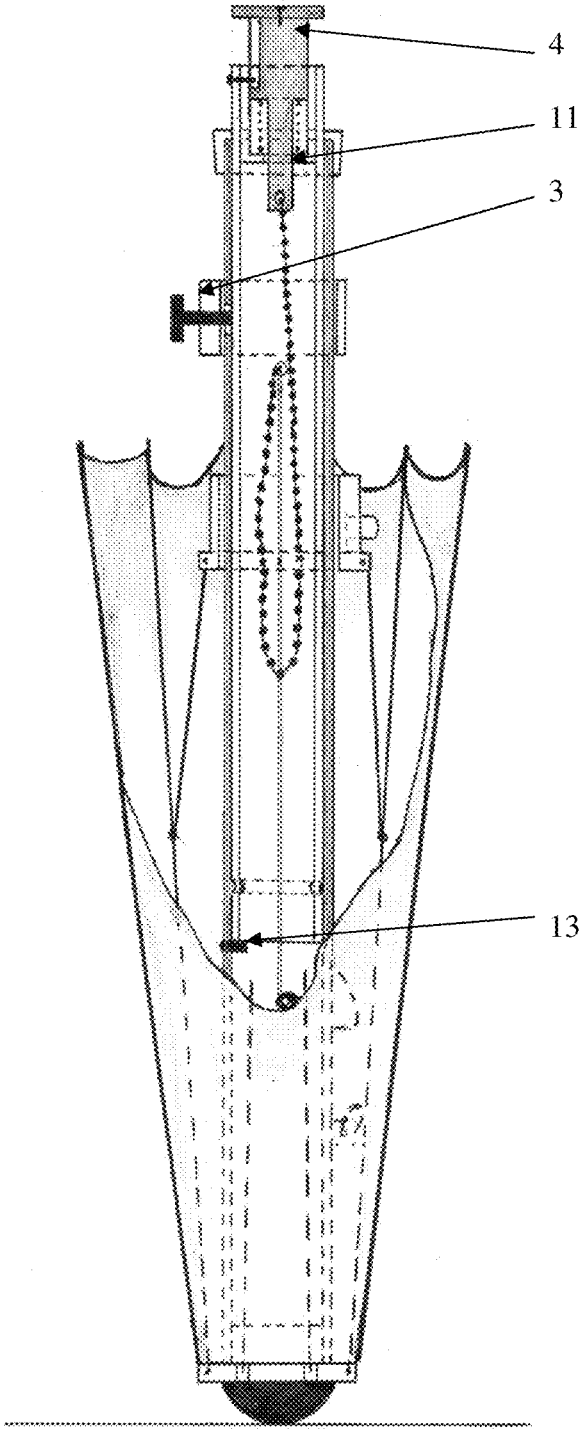
FIG. 3 shows the sunshade in the storage or transport configuration when the spike is retracted inwards.

For putting away the sunshade when it is closed, as shown in FIG. 3, the spike 2 is completely retracted inside the mast 1 until it abuts upon the lug 13, the ball chain 6 being pushed back without any risk of entanglement. Next, the blocking system 3, similar to the systems used on conventional sunshades, either with pressure screws 19, or with an eccentric cam lever, is actuated so as to immobilize the spike during this storage phase.

Figure 4:
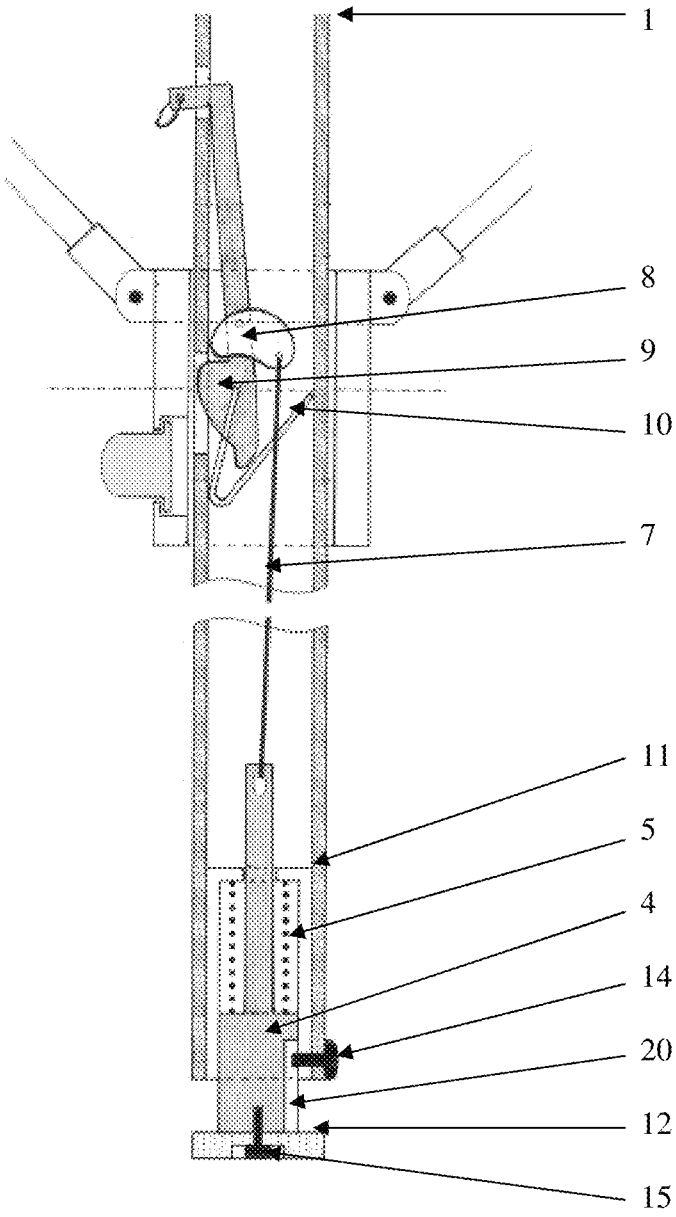
FIG. 4 shows an application of the invention on a sunshade without any spike directly supported on its mast.

An alternative of the invention shown in FIG. 4 relates to a sunshade not having any spike and being directly supported on its mast 1. In this case, the transmission system is simplified at the transmission system which may be made with a simple link 21 directly connecting the head of the slide 4 to the cam 8.

The invention claimed is:

1. An umbrella comprising:

a mast to be inserted on a ground;

a trigger located inside the mast, the trigger retains a runner on the mast;

a closure system including a security system for closing the umbrella in case of lifting of the umbrella, the security system comprising:

a triggering system located on a contact area of the mast with the ground, the triggering system comprising a slider, a slider return spring, and a flexible transmission assembly connected to the head of the slider;

a mechanism to inactivate the triggering system, the mechanism including a cam pivotally mounted on the trigger, the cam is capable of resting against the mast, the cam being connected to said flexible transmission assembly, a pole for contacting the ground, the pole is retractable in the mast;

wherein when a downward end of the umbrella leans against the ground, the weight of the umbrella compresses said spring and the slide is an active upper position in which said cam does not press against the mast; when said downward end of the umbrella does not lean against the ground or when the wind tends to lift the umbrella, said spring expands and pushes the slide to a lower triggering position in which said flexible transmission assembly is tensioned, which causes the cam to rotate and to bear against the mast, thereby inducing the withdrawal of the trigger inside the mast ensuring the automatic closing of the umbrella;

wherein said pole is telescopically retractable inside the mast until it abuts on a pin, a locking system of the pole being then operated to immobilize said pole.

2. The umbrella according to claim 1, wherein said flexible transmission assembly includes a chain made of a series of balls linked or articulated one with each other, connected to a piano wire.

3. An umbrella comprising:

a mast to be inserted on a ground;

a trigger located inside the mast, the trigger retains a runner on the mast;

a closure system including a security system for closing the umbrella in case of lifting of the umbrella, the security system comprising:

a triggering system located on a contact area of the mast with the ground, the triggering system comprising a slider, a slider return spring, and a flexible transmission assembly connected to the head of the slider;

a mechanism to inactivate the triggering system, the mechanism including a cam pivotally mounted on the trigger, the cam is capable of resting against the mast, the cam being connected to said flexible transmission assembly, further including a pole for contacting the ground, the pole is retractable in the mast, a pole for contacting the ground, the pole is retractable in the mast;

wherein when a downward end of the umbrella leans against the ground, the weight of the umbrella compresses said spring and the slide is an active upper position in which said cam does not press against the mast; when said downward end of the umbrella does not lean against the ground or when the wind tends to lift the umbrella, said spring expands and pushes the slide to a lower triggering position in which said flexible transmission assembly is tensioned, which causes the cam to rotate and to bear against the mast, thereby inducing the withdrawal of the trigger inside the mast ensuring the automatic closing of the umbrella;

wherein the triggering device is fitted in a sleeve located at the downward end of the pole or of the mast, and is closed by a lid and blocked by a first screw, the slider being guided in translation by a second screw having an end housed in a groove of the slider.

4. An umbrella comprising:

a mast to be inserted on a ground;

a trigger located inside the mast, the trigger retains a runner on the mast;

a closure system including a security system for closing the umbrella in case of lifting of the umbrella, the security system comprising:

a triggering system located on a contact area of the mast with the ground, the triggering system comprising a slider, a slider return spring, and a flexible transmission assembly connected to the head of the slider;

a mechanism to inactivate the triggering system, the mechanism including a cam pivotally mounted on the trigger, the cam is capable of resting against the mast, the cam being connected to said flexible transmission assembly, further including a pole for contacting the ground, the pole is retractable in the mast, a pole for contacting the ground, the pole is retractable in the mast;

a ring having inner resilient tongues, the pole having an annular groove, said pole being capable to snap with respect to said ring, by said tongues snapping in said annular groove, the pole is adapted to be telescopically fully extended and self-blocked at the optimal length for the appropriate tensioning of said chain and piano wire;

wherein when a downward end of the umbrella leans against the ground, the weight of the umbrella compresses said spring and the slide is an active upper position in which said cam does not press against the mast; when said downward end of the umbrella does not lean against the ground or when the wind tends to lift the umbrella, said spring expands and pushes the slide to a lower triggering position in which said flexible transmission assembly is tensioned, which causes the cam to rotate and to bear against the mast, thereby inducing the withdrawal of the trigger inside the mast ensuring the automatic closing of the umbrella.

* * * * *